US009950408B2

(12) United States Patent
Palushaj et al.

(10) Patent No.: US 9,950,408 B2
(45) Date of Patent: Apr. 24, 2018

(54) ABRASIVE PAD

(75) Inventors: Simon Palushaj, Washington, MI (US); Jerry Duda, Shelby Township, MI (US)

(73) Assignee: Diamabrush LLC, Madison Heights, MI (US)

( * ) Notice: Subject to any disclaimer, the term of this patent is extended or adjusted under 35 U.S.C. 154(b) by 977 days.

(21) Appl. No.: 12/938,149

(22) Filed: Nov. 2, 2010

(65) Prior Publication Data

US 2011/0104999 A1 May 5, 2011

Related U.S. Application Data

(60) Provisional application No. 61/257,286, filed on Nov. 2, 2009.

(51) Int. Cl.
*B24D 11/00* (2006.01)
*B24D 11/02* (2006.01)

(52) U.S. Cl.
CPC ..... *B24D 11/00* (2013.01); *B24D 11/02* (2013.01)

(58) Field of Classification Search
CPC ..... B24D 11/00; B24D 11/02
USPC ..... 451/527, 530, 532
See application file for complete search history.

(56) References Cited

U.S. PATENT DOCUMENTS 2,740,239 A * 4/1956 Ball et al. ..... 451/536
2,876,086 A 3/1959 Raymond
2,984,052 A * 5/1961 Mueller, Jr. ..... 451/536
3,828,485 A * 8/1974 McClure ..... 451/546
3,860,400 A 1/1975 Prowse et al.
3,861,892 A * 1/1975 Wisdom et al. ..... 51/295
4,047,902 A 9/1977 Wiand
4,282,011 A * 8/1981 Terpay ..... 51/298
4,314,589 A * 2/1982 Buchanan et al. ..... 139/383 A
4,949,511 A * 8/1990 Endo et al. ..... 51/295
4,974,642 A * 12/1990 Taipale ..... 139/383 A
5,131,924 A * 7/1992 Wiand ..... 51/293
5,203,881 A * 4/1993 Wiand ..... 51/293
6,024,634 A * 2/2000 Hoglund et al. ..... 451/532
6,383,064 B1 * 5/2002 Eggert et al. ..... 451/526
6,419,572 B2 * 7/2002 Moore ..... 451/530
6,482,308 B1 * 11/2002 Wiemann ..... 205/222
6,672,952 B1 * 1/2004 Masmar et al. ..... 451/539
7,108,019 B2 * 9/2006 Nagura et al. ..... 139/383 A
7,258,705 B2 * 8/2007 Woo et al. ..... 51/298
7,438,635 B2 * 10/2008 Hoglund ..... 451/527
7,517,277 B2 * 4/2009 Muldowney ..... 451/527
2003/0013397 A1 * 1/2003 Rhoades ..... 451/527
2008/0220703 A1 * 9/2008 Jung ..... 451/539

* cited by examiner

*Primary Examiner* — Eileen Morgan
(74) *Attorney, Agent, or Firm* — Bejin Bieneman PLC

(57) ABSTRACT

Disclosed is an exemplary abrasive pad having a plurality of first elongated members and a plurality of second elongated members arranged crosswise relative to the first elongated members to form a mat having a first side and an opposite second side. The second elongated members alternately pass over and under the first members in a serpentine manner, and include a longitudinal concave region and a longitudinal convex region. The abrasive pad includes an abrasive material affixed to the convex region of at least one of the plurality of second elongated members, wherein the concave region of the second elongated members are devoid of abrasive material.

17 Claims, 2 Drawing Sheets

ABRASIVE PAD

CROSS REFERENCE TO RELATED APPLICATIONS

This application claims the benefit of U.S. Provisional Application Ser. No. 61/257,286 filed Nov. 2, 2009, which application is hereby incorporated by reference in its entirety.

BACKGROUND

Abrasive materials have long been used for sanding, grinding and polishing. The abrasive material wears down the surface of the work by a cutting action. Rough surfaces, rough edges, coatings, and the like, may be removed by the abrasive action. The abrasive material may be bound to a substrate or backing in order to provide a convenient, easy to use abrasive tool. Abrasive tools may be desirable over other abrading techniques, such as sandblasting, and other spray or rubbing techniques employing loose abrasive materials. One benefit may be better cleanup and less dust or mess left over due to loose abrasive grit. One common abrasive device is referred to as sandpaper, which has sand or other grit material bonded onto a paper type backing. Sand paper may be used manually and in power tools such as orbital, random or belt tools. While sandpaper is a common media for abrading many materials, such as wood, it may have limited durability.

DETAILED DESCRIPTION

Figure 1:
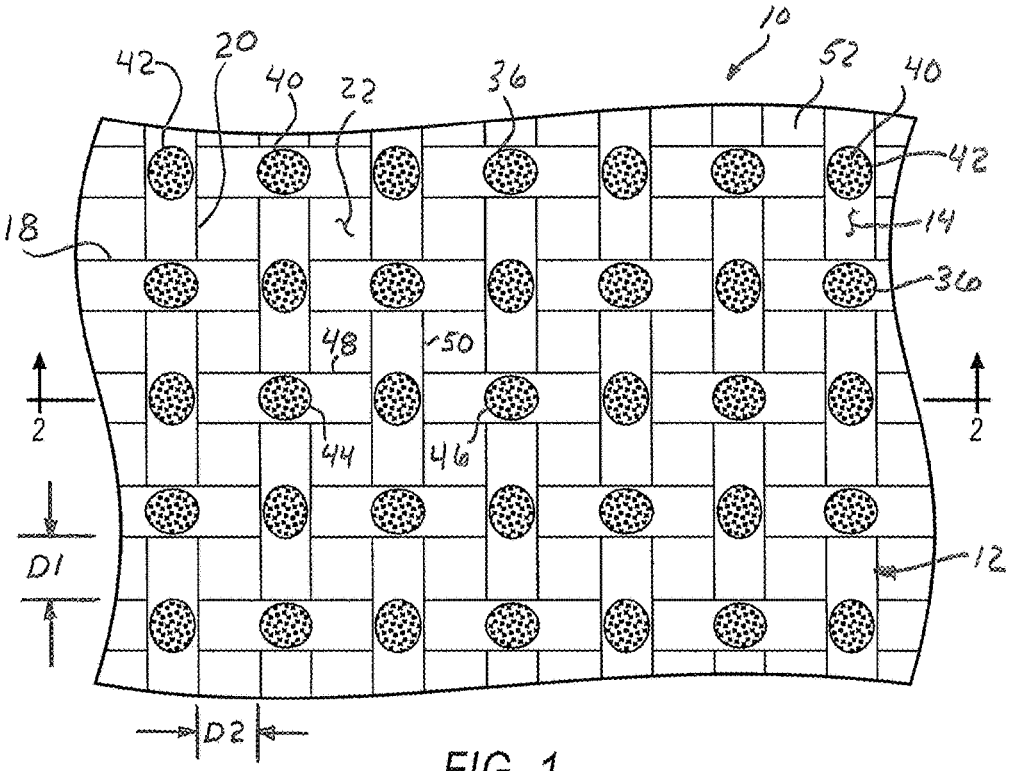
FIG. 1 is a plan view of an exemplary abrasive pad.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

Figure 2:
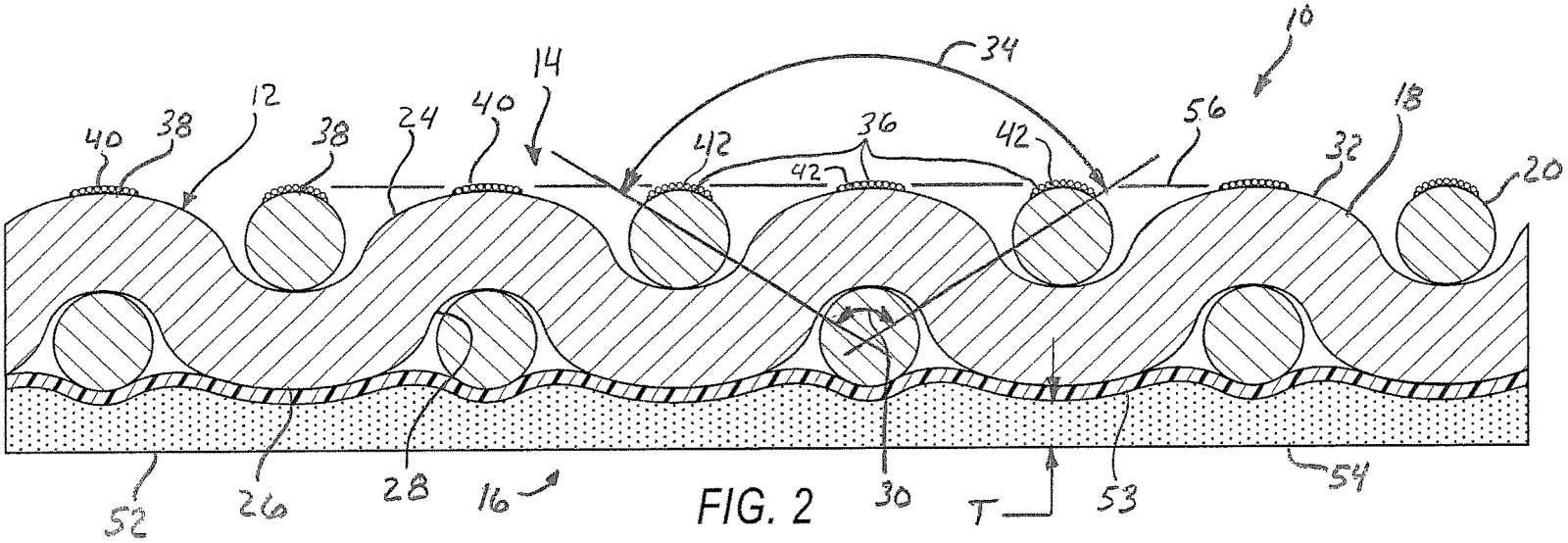
FIG. 2 is a partial cross-sectional view of the exemplary abrasive pad.

Referring to FIGS. 1 and 2, an exemplary abrasive pad 10 may include a woven mat 12 for supporting an abrasive material. Abrasive pad 10 may be used in various sanding operations for removing material and polishing surfaces. Mat 12 may include an upper side 14 and an opposite lower side 16, when viewed from the perspective shown in FIGS. 2 and 3. The designations "upper" and "lower" are assigned as a convenient means for identify the opposite sides of the mat for purposes of discussion only. The terms are not intended to limit the configuration of abrasive pad 10, or restrict its use to a particular orientation.

Mat 12 may have any of a variety of configurations. For example, mat 12 may include a plurality of interwoven weft strands 18 and warp strands 20. Weft strands 18 may be arranged in a generally crosswise direction relative to warp strands 20. In the exemplary configure shown in FIG. 1, the warp and weft strands are shown arranged perpendicular to one another. Alternatively, weft strands 18 may be arranged at an oblique angle relative to warp strands 20.

The individual weft strands 18 may be arranged generally parallel to one another, and similarly, the individual warp strands 20 may be arranged generally parallel to one another. The individual weft strands 18 may be spaced a distance (D1) apart from one another, and the individual warp strands 20 may be spaced a distance (D2) apart from one another. The spacing creates openings 22 that extend through mat 12. Spacing the individual weft and warp strands apart from one another may increase the flexibility of abrasive pad 10, and also provides cavities for collecting sanding debris generated during the sanding process.

Weft strands 18 and warp strands 20 may be made from any of a variety of materials, including but not limited to, stainless steel and carbon steel. Depending on the material employed, weft strands 18 and warp strands 20 may be coated with a protective coating, such as lacquer, to inhibit corrosion. Weft strands 18 and warp strands 20 may have a variety of cross-sectional shapes, including for example, circular, oval, square, rectangular, and polygonal, as well as others. For purposes of discussion, weft strands 18 and warp strands 20 are illustrated as having a circular cross-section, but in practice, may have a different cross-sectional shape. Weft strands 18 and warp strands 20 may have a common cross-sectional shape, or may each employ a different cross-sectional shape. It is not necessary that each individual weft strand have the same cross-sectional shape. Similarly, it is not necessary that each individual warp strand have the same cross-sectional shape. Well strands 18 and warp strands 20 may have a common or a different cross-sectional area. For example, although weft strands 18 and warp strands 20 are shown in FIG. 2 as having substantially the same diameter, in practice, the warp strands and weft strands may have different diameters.

A variety of techniques may be employed for interweaving weft strands 18 with warp strands 20. For example, weft strands 18 may be alternately threaded over and under warp strands 20, as shown, for example, in FIG. 2. Similarly, warp strands 20 may be alternately threaded over and under weft stands 18. The weaving process imparts a serpentine-like wave to weft strands 18 and warp strands 20, when viewed from a side edged of abrasive pad 10 along a plane of the pad. FIG. 2 illustrates an exemplary serpentine-like wave that may be imparted to weft strands 18. A similar wave may be imparted to warp strands 20.

Weft strands 18 may be fixedly attached to warp strands 20 at the point where the strands cross one another. Weft strands 18 may alternately be detached from warp strands 20 to allow the strands to slide past one another as mat 12 is flexed, which may increase the flexibility of abrasive pad 10. Fixedly attaching weft strands 18 to warp strands 20 prevents the weft strands from sliding past the warp strands as mat 12 is flexed, which may result in decreased flexibility of abrasive pad 10. The flexibility of abrasive pad 10 may be varied by adjusting the number and locations at which weft strands 18 are fixedly attached to warp strands 20. Generally speaking, the flexibility of abrasive pad 10 decreases as the number of fixed connections between weft strands 18 and warp strands 20 increases.

Continuing to refer to FIG. 2, weft strands 18 may consist of a series of alternating bends 24 and 26 where weft strands 18 extend in an arc around warp strands 20 as the weft strands snake over and under the warp strands. A side 28 of weft strand 18 located adjacent warp strand 20 includes a concave region 30, and an opposite side 32 of weft strand 18 includes a convex region 34. Warp strands 20 may similarly consist of a series of alternating bends occurring where warp strands 20 extend in an arc around weft strands 18, as the warp strands snake over and under weft strands 18. Similar to weft strands 18, a side of warp strand 20 located adjacent weft strand 18 includes a concave region, and an opposite side of warp strand 20 includes a convex region.

Mat 12 may include an abrasive material 36 securely attached to weft strands 18 and warp strands 20 along upper side 14 of abrasive pad 10. To help maximize the effectiveness of the abrasive material, and minimize the amount of abrasive material used to produce abrasive pad 10, distribution of the abrasive material may be limited to those regions of the abrasive pad likely to come into contact with a surface being sanded. Regions that generally do not contact the sanding surface do not receive abrasive material. In the exemplary abrasive pad 10, abrasive material 36 is shown disposed along upper side 14 of abrasive pad 10, but not lower side 16. In practice, however, the abrasive material may be disposed on one or both upper side 14 and lower side 16 of abrasive pad 10.

Upper side 14 of exemplary abrasive pad 10 may be configured to generally contact the surface being sanded along an apex 38 of convex region 34 of weft stands 18 and warp strands 20. Depositing abrasive material within the convex region will generally make effective use of the abrasive material. In contrast, concave region 30 generally does not contact the sanding surface, and as a consequence, it would be an inefficient use of the abrasive material to locate the material within the concave region. Thus, to help maximize the effectiveness of abrasive pad 10, and minimize the amount of abrasive material used to produce the abrasive pad, abrasive material 36 is generally deposited on weft strands 18 and warp strands 20 over at least a portion of convex region 34, but is generally not deposited within concave region 30.

Abrasive material 36 may include abrasive particles 40, which may include, for example, alumina silicate, silicone carbide, and industrial diamond particles, as well as other materials. The abrasive particles 40 may be securely adhered to convex region 34 of weft strands 18 and warp strands 20 using any of a variety of methods, including but not limited to, brazing, plating, soldering and gluing. For example, abrasive particles 40 may be dispersed within a brazing nickel alloy slurry that may be applied to convex region 34 of weft strands 18 and warp strands 20. The brazing material securely attaches abrasive particles 40 to weft strands 18 and warp strands 20. The abrasive particles may be arranged in discrete patches 42 within the convex region of the weft and warp strands. Consecutive abrasive patches arranged along a given weft or warp strand may be separated by an intervening strand crossing the strand to which the abrasive patches are attached. For example, with reference to FIG. 1, abrasive patches 44 and 46 located on weft strand 48 are separated by warp strand 50 that extends between the two abrasive patches.

With continued reference to FIG. 2, abrasive pad 10 may also include a foam backing 52 attached to one side of mat 12. In the illustrated exemplary configuration, foam backing 52 is attached to lower side 16 of mat 12. Foam backing 12 may consist of a closed cell or open cell foam material. Closed cell foam and open cell foam typically have different physical properties. For example, closed cell foams generally do not absorb liquids as well as open cell foams due to their closed cell structure. The open cell structure of open cell foam enables the material to readily absorb and retain moisture. Closed cell foam may be particularly useful in applications where the ability to absorb moisture is not necessary or particularly desirable. Other applications, such as wet sanding, however, may benefit from the use of an open cell foam that has the ability to absorb moisture, which can then be released during the sanding process. The selection of the type of foam employed for foam backing 52 may depend at least in part on the requirements of the particular application, although, for many applications either material may work equally well.

Foam backing 52 may be attached to mat 12 by extruding the foam material directly onto mat 12. This may allow the foam backing to seep into pockets and voids in lower side 16 of mat 12 to help create a secure bond between mat 12 and foam backing 52. Foam backing 52 may also be attached to mat 12 by other means, such as an adhesive. A barrier layer 53 may also be arranged between mat 14 and backing 52. Barrier layer 53 may prevent the foam material from passing through opening 22 (see FIG. 1) in mat 12 when attaching the foam backing to the mat. Barrier layer 53 may consist of various materials, including but not limited to, a samfa blocker material. Barrier layer 53 may be applied to mat 14 prior to applying the foam backing.

A thickness "T" of foam backing 52 may be varied to accommodate the requirements of a particular application. For example, increasing the thickness T of foam backing 52 will generally produce a corresponding increase in the stiffness of abrasive pad 10, whereas decreasing the thickness T may produce a corresponding decrease in stiffness. Other factors that may also influence the thickness of foam backing 52 may include a need for shock absorption, the desired flexibility of the abrasive pad, durability considerations, and the ability to retain moisture, as well as others. For example, increasing the thickness T of foam backing 52 may allow abrasive pad 10 to better conform to the contours of the surface being sanded. Although foam backing 52 is illustrated in FIG. 2 as having a generally flat outer surface 54, other contours may also be employed.

Figure 3:
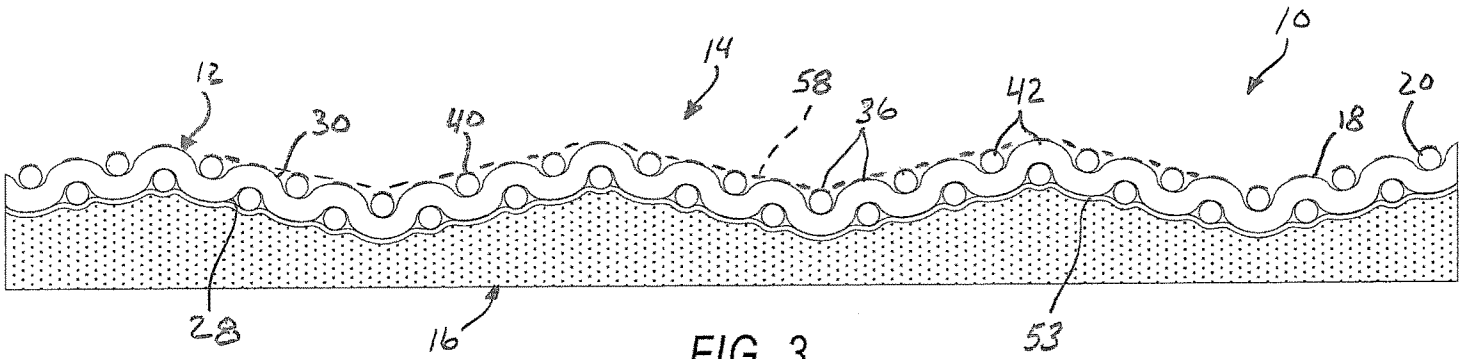
FIG. 3 is a partial cross-sectional view of the exemplary abrasive pad employing a secondary topography.

Continuing to refer to FIG. 2, abrasive patches 42 are shown arranged generally along a common plane 56. Abrasive pad 10 may also be configured to include a secondary topography employing a non-planer contour over which abrasive patches 42 may be arranged. An example of a non-planer secondary topography is shown in FIG. 3. The contour of the secondary topography is represented by a dashed line 58 that passes through abrasive patches 42. Abrasive patches 42 may be arranged in the same manner as discussed above, with abrasive material 36 located within convex region 34 (see FIG. 2) of weft strands 18 and warp strands 20, and concave regions 30 (see FIG. 2) being devoid of abrasive material. The exemplary secondary topography 58 is shown to include a wave-like contour, although other contours may also be employed. Secondary topography 58 may be applied in one direction, for example, in a direction parallel to weft strands 18, or in multiple directions, for example, in a direction parallel to weft strands 18 and in a second direction parallel to warp strands 20. The contour of secondary topography 58 may include a continuously repeating geometric profile, such as illustrated in FIG. 3, or may have a non-uniform shape. Foam backing 52 provides support for mat 12, which helps maintain the contour of secondary topography 58. Regardless of the contour of secondary topography 58, the location of abrasive material 36 is generally limited to convex regions 34 of the weft and warp strands, with concave regions 30 being devoid of abrasive material.

Abrasive pad 10 may be used in a variety of sanding applications. For example, abrasive pad 10 may be configured as a sheet suitable for manual sanding operations. It may also be configured for use with mechanical sanding devices, such as a belt sander, disk sander, and drum sander.

Figure 4:
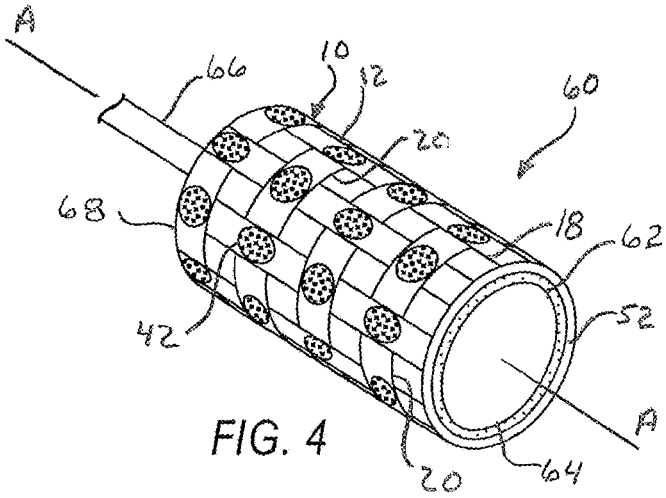
FIG. 4 is a perspective view of a drum sanding device employing the exemplary abrasive pad.

An example of abrasive pad 10 configured for use with a mechanical sanding device is shown in FIG. 4, which illustrates a sanding drum 60 for used with a rotary sanding device, such as a drill motor. Sanding drum 60 may include a cylindrical drum 62. Abrasive pad 10 may be attached to an outer circumferential surface 64 of drum 62 using a variety of means, such as adhesives, brazing, and soldering, as well as others. Abrasive pad 10 attached to drum 62 may be configured in the manner described above. Abrasive pad 10 may include mat 12 consisting of interwoven weft strands 18 and warp strands 20. Although weft strands 18 are shown arranged generally parallel to a longitudinal axis A-A of drum 62, and warp strands 20 generally perpendicular to axis A-A, the strands may also be arranged at an oblique angle to axis A-A. Abrasive patches 42 may be attached to convex region 34 (see FIG. 2) of weft strands 18 and warp strands 20. Abrasive pad 10 may include foam backing 52, which may be attached to drum 62. Depending on the requirements of the particular application, abrasive pad 10 may be configured without foam backing 52, in which case mat 12 may be directly attached to drum 62.

Sanding drum 60 may include a shaft 66 for attaching the sanding drum to a mechanical drive device, such a drill motor. An end of shaft 66 may be attached to an end 68 of drum 62. A longitudinal axis of shaft 68 may be substantially coaxially aligned with longitudinal axis A-A of drum 62.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously or generally simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. An abrasive pad comprising:

a plurality of first elongated members;

a plurality of second elongated members arranged crosswise relative to the first elongated members to form a mat having a first side and an opposite second side, the second elongated members alternately passing over and under the first members in a serpentine manner and having a longitudinal concave region and a longitudinal convex region, the longitudinal convex region includes a curved apex region at the top of the convex region;

wherein the plurality of first elongated members and the plurality of second elongated members define apertures extending from the first side of the mat to the second side of the mat; and an abrasive material affixed to the curved apex region of the convex region of at least one of the plurality of second elongated members, the concave region of the second elongated members being devoid of abrasive material wherein the curved apex region generally contacts a surface to be sanded.

2. The abrasive pad of claim 1 further comprising:

a foam backing; and a barrier layer disposed between the second side of the mat and the foam backing, the barrier layer attached to at least one of the mat and the foam backing.

3. The abrasive pad of claim 2, wherein the foam backing comprises a closed cell material.

4. The abrasive pad of claim 1, wherein the first members slidably engage the second members.

5. The abrasive pad of claim 1 further comprising a cylindrically shaped drum having an outer circumferential surface, wherein one of the first and second sides of the mat is at least partially attached to the outer circumferential surface of the drum.

6. The abrasive pad of claim 1, wherein the curved apex region has a substantially round cross section.

7. The abrasive pad of claim 1, wherein the curved apex regions of the first elongated members and second elongated members have a substantially round cross section.

8. The abrasive pad of claim 2, wherein the second side of the mat abuts the barrier layer and the entire first side of the mat is spaced from the barrier layer.

9. The abrasive pad of claim 2, wherein the second side of the mat abuts the barrier layer and the entire first side of the mat is exposed from the barrier layer.

10. An abrasive pad comprising:

at least one elongated first member;

at least one elongated second member arranged in a crosswise direction relative to the at least one first member, the second member having a plurality of curved apex regions where the at least one first member crosses the at least one second member, the at least one first and second members forming a mat having a first side and an opposite second side;

at least one discrete patch of abrasive material fixedly attached to at least one of the at least one of the plurality of second members at the curved apex region;

a barrier layer affixed to one side of the mat; and a foam layer affixed to the barrier layer opposite the mat.

11. The abrasive pad of claim 10, wherein a side of the at least one second members adjacent the at least one first member defines a concave region and an opposite side of the at least one second member defines a convex regions, the concave regions of the at least one second members being devoid of abrasive material.

12. The abrasive pad of claim 10, wherein the at least one first member includes a plurality of first members, each of the first members spaced apart from an adjacent second member, and the at least one second member includes a plurality of second members, each of the second member being spaced apart from an adjacent second member.

13. The abrasive pad of claim 10, wherein the at least one first member includes a plurality of first members, and the at least one second member includes a plurality of second members, the first and second members at least partially defining apertures extending from the first side of the mat to the second side of the mat.

14. The abrasive pad of claim 10, wherein the at least one first member includes a plurality of first members and the at least one second member includes a plurality of second members, a second member being disposed between each successive abrasive patch on the first member, and a first member being disposed between each successive abrasive patch on the second member.

15. The abrasive pad of claim 10, wherein the curved apex region has a substantially round cross section.

16. The abrasive pad of claim 10, wherein the first elongated members alternately pass over and under the second elongated members in a serpentine manner and include a longitudinal concave region and a longitudinal convex region, the abrasive material being affixed to the apex region of the convex region of at least one of the plurality of first elongated members, the concave region of the first elongated members being devoid of abrasive material.

17. The abrasive pad of claim 16, wherein the curved apex regions of the first elongated members and second elongated members have a substantially round cross section.

* * * * *